United States Patent [19]

Wilkins

[11] Patent Number: 5,027,448

[45] Date of Patent: Jul. 2, 1991

[54] MEN'S ANTI-SPLASHBACK HYGENIC URINAL

[76] Inventor: Bruce F. Wilkins, 100 Hemlock 2-1, Branford, Conn. 06405

[21] Appl. No.: 541,509

[22] Filed: Jun. 20, 1990

[51] Int. Cl.[5] ..... E03D 13/00

[52] U.S. Cl. ..... 4/310; D23/302

[58] Field of Search ..... 4/301, 310, 311, 459, 4/460, 463; D23/302

[56] References Cited

U.S. PATENT DOCUMENTS

| | | | |
|---|---|---|---|
| D. 193,765 | 10/1962 | Bollin | D23/302 |
| D. 258,682 | 3/1981 | Wilson | D23/302 |
| D. 275,600 | 9/1984 | Stairs | D23/302 |
| D. 281,270 | 11/1985 | Doman | D23/302 |
| D. 294,966 | 3/1988 | Kohler | D23/302 |
| D. 300,351 | 3/1989 | Juaire | D23/302 |
| 1,018,966 | 2/1912 | Davidson | 4/310 |
| 1,114,670 | 10/1914 | Baker | 4/310 |
| 2,147,588 | 2/1939 | Zinkil | 4/310 |
| 2,182,980 | 12/1939 | Bruzenak | 4/310 |
| 4,044,405 | 8/1977 | Kreiss | 4/301 |
| 4,446,585 | 5/1984 | Harding et al. | 4/460 |

FOREIGN PATENT DOCUMENTS

| | | | |
|---|---|---|---|
| 766 | 12/1897 | United Kingdom | 4/310 |
| 1662 | 12/1900 | United Kingdom | 4/310 |

OTHER PUBLICATIONS

Kohler Co., Catalog/p. 13-3, the 'Bardon'-Model *Anti--Splashback* Urinal Illustration, no effective date given.

*Primary Examiner*—Ernest G. Cusick
*Assistant Examiner*—Robert M. Fetsuga

[57] ABSTRACT

A urinal having a pair of sidewalls which are integrally connected at rear edges thereof to form a V-shaped configuration. The apex of the V-shaped configuration is offset from a plane perpendicular to a plane defined by the front edges of the sidewalls. Both a wall mounted and full height urinal is disclosed.

9 Claims, 1 Drawing Sheet

10
12
13
14
15
16
17
17'
18
18'
19
20
20'
21
22
23
23'
24
31
32
13'
13"
14'
a.
b.
c.
d.
5

MEN'S ANTI-SPLASHBACK HYGENIC URINAL

(I.) BACKGROUND OF THE INVENTION

This invention relates to restroom wall type stand-up stall urinal receptacle apparatus, and particularly in regards to features which may serve to impede the occurrence of an offensive splashback condition.

Accordingly, a search of American patents has revealed some limited activity in the area of anti-splashback considerations. For example, U.S. Pat. No. 1,018,966 shows faulty construction such as is commonly seen to this day, in that the one-piece receptor structure exhibits a somewhat protruding basin-lip with symmetrical right and left halfs provided with a wide opening and a substantially perpendicular and transversely recessed back-wall portion, while the top is setback somewhat from the vertically protruding sidewall portions. A similar configuration is also seen in later U.S. Pat. No. 2,147,588.

Next, U.S. Pat. No. 1,114,670 demonstrated what could well be the most thoughtfully devised construction patented to date, in that the inventor arranged the urinal as a corner-piece presumably as an adjunct to greater privacy, while the right and left hand vertical sidewalls actually wrap inward toward themselves. This wrap merges especially close as the receptor aperture approaches the floor region, where only a narrow vertical-slot aperture remains; the effect being to lessen "urine spatterings upon the shoes and lower trousers of the user, as well as an unsanitary condition around the immediate floor area". Unfortunately, the extremely enclosed urinal-cavity or chamber shape eventually itself results in poor hygienic conditions, since it is so enclosed as to make routine cleaning-maintenance a rather hit-and-miss procedure whereby scum begins to collect aggressively therein.

More recent urinal construction of some relevants is found in U.S. Pat. Nos. D258,682, D275,600, D281,270, D294,966, and D300,351; all of which are remarkably of the abbreviated wall-hung type, which have eliminated the lower floor extension entirely in effort to overcome the lower splashback problem at least. Of these, U.S. Pat. No. D294,966 by Kohler Co. attempts to alleviate the splashback problem to some extent by provision of a symmetrically formed v-shaped backwall convergence construction, which was interestingly also represented in the above mentioned 1912/Baker construction. It is worth mentioning that Kohler Co./USA currently advertises this as their Bardon TM "Anti-splash design" in their sales-catalogs.

Therefore, the inventor hereof believes he has devised a rather radical however attractive departure from established urinal receptor construction concepts, and so working in conjunction with Inventech/R&D-Co. of SanDiego refers to it as the "mistless" HYGENIX TM -Urinal; which shall now be well set forth in detail.

(II.) SUMMARY OF THE INVENTION

With due consideration to the foregoing history of evolving efforts to develop a truly effective wall type anti-splashback mens urinal apparatus, the subsequent text will set forth the objectives and features of this inventor's preferred embodiments toward achieving the essential anti-splashback performance desired. Therefore:

(A.) an object of this invention is to set forth a men's stand-up urinal apparatus, wherein a special horizontal/cross-section configuration is presented, the novel function thereof being to provide an arrangement whereby one sidewall surface entry into the receptor confines is substantially perpendicular to the users body front, while the opposite and aftwardly (or inwardly) contiguously adjoining sidewall surface portion is arranged as a pronounced oblique convergence angle within the same cross-section (horizontal); hence, an asymmetric receptor cavity wherein both sidewalls cant toward a common inward convergence-point, preferably offset laterally further than the frontal opening's nearest side surface of reference.

(B.) Another object of this invention is to set forth a mens stand-up urinal apparatus as described in item-A, wherein the pronounced asymmetric receptor cavity cross-section has been discovered to perform much more effectively in anti-splashback function owing to the absence of any actual retrodeflecting(splash deflection back toward the user) backwall portion which is commonly oriented in a manner as to redirect the force of urine back toward the person.

(C.) Another object of this invention is to set forth a mens stand-up urinal apparatus as described in proceeding items-A/B, wherein the asymmetrically formed receptor cavity sidewall portions may be provided with a recess-step particularly down the one obliquely angled sidewall surface near the entry region; or, the said obliquely angled wall surface may simply feature a radius transition in horizontal cross-section at the junction where the surface merges at an approximate right-angle with the frontal facing surface of the urinal structure; in any case, the object being to virtually eliminate any receptor surface which could possibly induce a splashback condition.

(D.) Another object of this invention is to set forth a mens anti-splashback stand-up urinal apparatus which is at the same time relatively easy to maintain in a desirably clean and sanitary condition of use, since there are no actual hidden internal recesses of the cavity surfaces which could tend to collect surface scum.

(E.) Another object of this invention is to set forth a mens anti-splashback stand-up urinal which is constructed so as to be both at once partially recessed or set into the restroom-wall, while extending partially out into the restroom proper; thereby achieving a substantial depth of the receptor cavity, so as to be thereby present a deeper and more suitably formed asymmetric cross-section formation in those installations which permit such construction; otherwise, the urinal structure would be installed substantially outwardly from the room wall per se.

(F.) Another object of this invention is to provide for optional forms of construction, whereby the urinal structure may be arranged as either a right or left hand oriented assembly with respect to its oblique horizontal cross-section asymmetry, and may be an abbreviated wall mounted unit stationed at an average mid-body height extending down no further than the knees, or could extend entirely down to the floor.

(G.) Another object of this invention is to provide for a urinal as described above which would include the provision of a lower basin like portion having a horizontal transverse drip catching lip extending between the two said sidewalls; and wherein the lip may be substantially flush with the lower front of the urinal structure or even extend further outward toward the user (particularly between the user's feet) so as to be a more effective drip catcher.

(H.) Another object of this invention is to provide a substantially conventional arrangement of plumbing connection and integral water-manifold outletting so as to facilitate the convenient flushing of clean water down the cavity walls via gravity; the particular mode of operation being either manual or by other well known automatic system.

BRIEF DESCRIPTION OF THE DRAWINGS

The foregoing and still other objects of this invention will become fully apparent, along with various advantages and features of novelty residing in the present embodiments, from study of the following description of the variant configurations wherein indicia of reference are shown to match related points in the text, as well as the claims annexed hereto; and accordingly, a better understanding of the invention and the resultingly improved performance is intended, by reference to the drawings, which are considered as primarily exemplary, and not to be therefore construed as restrictive in nature.

DETAILED DESCRIPTION OF THE PREFERRED EMBODIMENTS

Figures 1, 2, 3, 4, 5:
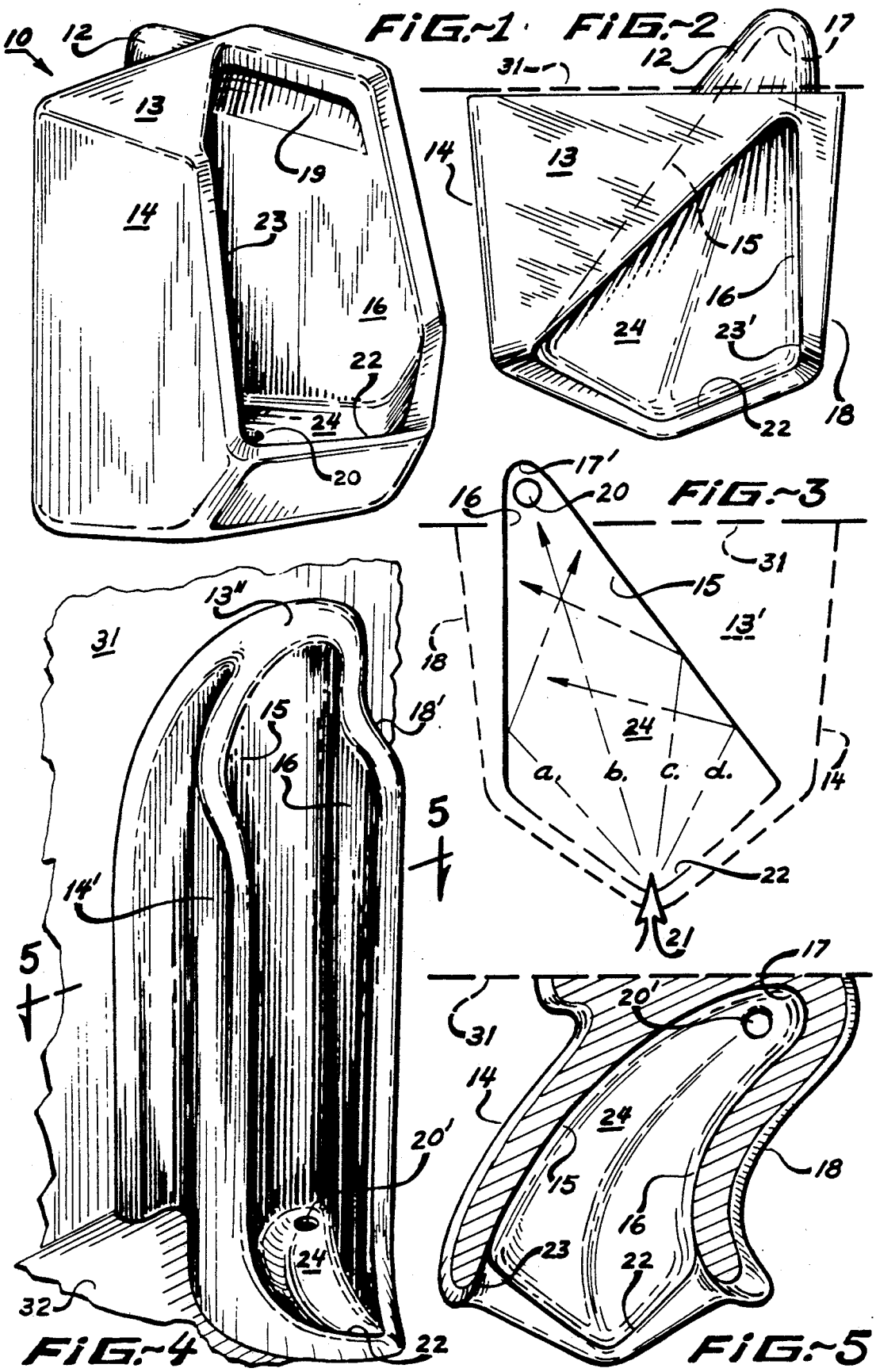
FIG. 1, is a ¾-frontal pictorial view showing a left-hand oblique asymmetric version of the invention.
FIG. 2, is a full top plan-view of the preceding embodiment.
FIG. 3, is a semi-diagrammatic representation of the embodiment set forth in FIGS. 1 and 2, wherein a series of typical anti-splashback spray deflection examples are indicated.
FIG. 4, is a ¾-frontal pictorial view showing a generic variant of the invention, as a left-hand oblique asymmetric version; including a horizontal cross-section reference line 5—5 .
FIG. 5, is an enlarged cross-section view of the invention as seen along line 5—5 in FIG. 4.

Initial reference is given to FIGS. 1 and 2, wherein is shown a special wall-hung type of mens urinal 10 revealing a unique asymmetrically formed internal sidewall 15 and opposing sidewall 16, having leading edge portions 23/23' thereto, the confines there between thus forming the receptor-cavity area, including lower bowl surface portion 24, bowl drain-outlet 20, and lower return-lip 22. Also indicated is an exemplified water flushing manifold outlet recess 19, which extends around the extreme upper region of the cavity walls 15/16 which actually converge aftwardly in a smoothly radiused cove region 17. The outer portions of the urinal include the top surface 13, opposite sidewalls 14 and 18, plus an aftward extension portion 12 which is actually recessed into the perpendicular restroom-wall 31, so as to attain greater anti-splashback efficiency as to spatial utilization.

Study of FIG. 3 reveals via demonstrated series of graphically represented urine spray vectors- a,b,c,d, how the special asymmetrical sidewall structure arrangement serves to prevent undesirable splashback, which would otherwise be a potential problem when disseminated from the user's frontal region at position 21. Note here, that there is no possibility of a retro-deflection occurrence, since all of the impinging spray vectors are resultantly caused to be deflected inwardly away from the frontally central source, no matter if the asymmetric shape be oriented toward the left or right (i.e.: FIG. 2 vs. FIG. 3).

Reference to FIG. 4 discloses a full length version of the asymmetric urinal, this embodiment being unlike the preceding sheer architecturally shaped examples, but this rather fashionably exotic if organically sculptured configuration serves to demonstrate how the concept lends itself to a variety of new functional formations, which would look particularly attractive in black porcelain for example. In FIG. 5 we see a horizontal cross-section of a similarly organic asymmetric shape, showing how the oblique sidewall 15 can be made to actually curve laterally in such a radical manner as to opposed sidewall 16 around as well, creating a pocket like recess toward one extreme side. Hence, while FIG. 2 sets forth an oblique sidewall in conjunction with a substantially perpendicular opposed sidewall (relative to the wall 31), the principle involved in FIG. 3 applies equally well to an increased asymmetry layout, wherein the more inward vertical center-line of reference is splayed laterally away from the actual frontally outward vertical center-line of visual reference.

While the generic variants hereof present a preferred V-shaped bowl presenting a likewise V-formation to the bowl lip 22 as studied in plan-view; a relatively flat bowl lip remiss of outward frontally protruding V-formation will suffice. Generally, the wall-hung urinal version is designed to extend vertically from an average male mid-body height position down to about average knee height; while the alternate fullheight versions extend from an average upper mid-body height position down to the floor-level; where the receptor bowl surface portion 14 may actually be recessed below the floor level 32.

Accordingly, it is understood that the utility of the foregoing adaptations of this invention are not dependent upon any prevailing invention patent necessarily; and while the present invention has been well described hereinbefore by way of several preferred embodiments, it is to be realized that various changes, alterations, rearrangements, and obvious modifications may be resorted to by those skilled in the art to which it relates, without substantially departing from the implied spirit and scope of the invention. Therefore, the invention has been disclosed herein by way of example, and not by thus imposed limitation.

What I claim of proprietary origin is:

1. An improved anti-splashback urinal comprising:

a pair of substantially vertically oriented sidewalls integrally joined along rear edges thereof to form a substantially V-shaped configuration in horizontal cross-section, said sidewalls having front edges lying in a plane defining an opening of said urinal, the apex of said V-shaped configuration being disposed such that a line passing through the apex and a point in said plane equidistant from said front edges forms an acute angle with respect to said plane; and, a bottom wall integrally joined with said sidewalls and having an interior surface sloping downwardly toward the apex of said V-shaped configuration, said bottom wall having a drain opening therethrough at a lowermost portion thereof.

2. A urinal as defined in claim 1, wherein the inner surface of the apex is arcuate and merges smoothly with said sidewalls.

3. A urinal as defined in claim 1, and further including flushing means for rinsing the inner surfaces of said urinal.

4. A urinal as defined in claim 3, wherein said flushing means includes a water manifold formed in a top portion of said sidewalls.

5. A urinal as defined in claim 1, wherein said acute angle can be on either side of said line.

6. A urinal as defined in claim 1, wherein said urinal is a wall mounted urinal.

7. A urinal as defined in claim 1, wherein said urinal is a full height floor mounted urinal.

8. A urinal as defined in claim 1, wherein said bottom wall includes a return lip formed in a front portion thereof.

9. A urinal as defined in claim 8, wherein said lip extends outwardly beyond said plane.

* * * * *